US008413595B2

(12) United States Patent
Grusha

(10) Patent No.: US 8,413,595 B2
(45) Date of Patent: Apr. 9, 2013

(54) NOZZLE FOR FEEDING COMBUSTION MEDIA INTO A FURNACE

(75) Inventor: John Grusha, Bethlehem, PA (US)

(73) Assignee: R-V Industries, Inc., Honey Brook, PA (US)

( * ) Notice: Subject to any disclaimer, the term of this patent is extended or adjusted under 35 U.S.C. 154(b) by 896 days.

(21) Appl. No.: 12/547,868

(22) Filed: Aug. 26, 2009

(65) Prior Publication Data

US 2011/0048293 A1 Mar. 3, 2011

(51) Int. Cl.
*F23D 1/00* (2006.01)
*F23K 3/02* (2006.01)

(52) U.S. Cl.
USPC ..... 110/104 B; 110/261; 110/265; 431/160

(58) Field of Classification Search ..... 110/260, 110/261, 263, 264, 265, 347, 104 B; 431/3, 431/159, 160, 181, 187, 190; 239/132, 132.1, 239/239/132.3, 132.5, 127.3, 127.1, 265.17, 239/265.23, 591, 600, 419.5, 424.5, 553.5, 239/590.5

See application file for complete search history.

(56) References Cited

U.S. PATENT DOCUMENTS

| | | | | |
|---|---|---|---|---|
| 2,485,058 | A * | 10/1949 | McKee | 431/177 |
| 3,918,834 | A * | 11/1975 | Sigal et al. | 431/10 |
| 6,916,172 | B2 * | 7/2005 | Steiner | 431/278 |
| 2006/0246387 | A1 * | 11/2006 | Smirnov | 431/181 |

* cited by examiner

*Primary Examiner* — Kenneth Rinehart
*Assistant Examiner* — David J Laux
(74) *Attorney, Agent, or Firm* — Howson & Howson LLP

(57) ABSTRACT

In a boiler furnace having nozzles for introducing combustion media such as air and coal, nozzle tip walls that have the greatest exposure to radiant heat and hot gases are provided with arrays of air holes that allow air to flow to the exposed sides of the walls from the opposite sides in order to reduce the temperature difference between the two sides and thereby reduce thermal distortion and damage resulting from oxidation.

9 Claims, 7 Drawing Sheets

NOZZLE FOR FEEDING COMBUSTION MEDIA INTO A FURNACE

FIELD OF THE INVENTION

This invention relates to nozzles for feeding combustion media, for example pulverized coal and air, into a furnace. The invention has particular application in pulverized coal feeding nozzles and secondary air nozzles in the tangentially fired burners of steam generating boilers. The invention is also applicable to various other kinds of combustion media nozzles.

BACKGROUND OF THE INVENTION

Many coal-fired power plant boilers are designed for tangential firing, i.e., a configuration in which streams of pulverized coal and air are directed into a rectangular furnace compartment from columns of nozzles located in such a way as to generate a slowly rotating cyclonic fireball, which produces heat which in turn boils water in arrays of water tubes lining the walls of the compartment. Tangential firing is described in various patents including U.S. Pat. Nos. 4,252,069, 4,634,054, and 5,483,906.

Tangentially fired boilers fueled by pulverized coal typically have pivotable coal nozzle tips protruding into the furnace. Biomass fuel nozzles are similar to these coal nozzles. The coal nozzle tips have a double shell configuration, comprising an outer shell and an inner shell. The inner shell is coaxially disposed within the outer shell to provide an annular space between the inner and outer shells. The inner shell is connected to a fuel feeding conduit or pipe for feeding pulverized coal, entrained in air flowing through the inner shell, into the furnace. The annular space between the inner and outer shells is connected to a secondary air conduit for feeding secondary air into the furnace. The secondary air not only serves as supplemental combustion air, but also cools the inner and outer shells. The fuel feeding pipe is typically disposed coaxially within in the secondary air conduit.

A furnace will typically have not only several coal nozzle tips at each corner, but also several air nozzle tips, arranged in a column along with the coal nozzle tips, to introduce additional secondary air into the furnace.

The nozzle tips, which are typically made from stainless steel plate having a thickness from ¼ to ¾ inch, are located in an opening in a nozzle supporting wall, typically in the outlet of the secondary air box. The external cross section of a nozzle tip is typically rectangular, and corresponds to the internal cross section of the outlet end of the air conduit. Narrow gaps between the peripheral walls of the nozzle tip and the walls of the air conduit allow leakage of secondary air into the furnace. When the nozzle tips discharge air, or fuel and air, horizontally into the furnace, the air leaking through these gaps flows along the external walls of the nozzle tips and normally prevents the nozzle tip from being heated excessively by radiation from the fire ball within the furnace.

In a typical tangentially fired burner, the nozzle tips are pivotable upward and downward so that the position of the fire ball can be controlled. When a nozzle tip is tilted to provide an upward or downward flow of air, or fuel and air, into the furnace, one of its walls will be bent away from the air flow leaking through the gap between that wall and an adjacent wall of the air conduit, and the protection afforded that wall by leaking air will be greatly diminished.

Unprotected exposure to radiation when the nozzle tips are tilted upward or downward, induces thermal gradients in the thick stainless steel. The thermal gradients cause distortion of the nozzle tips, and can even cause eventual closure of their air and fuel passages. Unprotected exposure to radiation also results in excessively high temperatures, oxidation, and thinning of the stainless steel plate. Thermal distortion and high temperature oxidation of the nozzle tips cause heavy damage to the nozzle tips and deterioration of combustion performance, requiring frequent and expensive replacement. Similar problems are encountered in the case of nozzle tips mounted for yaw adjustment or for both pitch and yaw adjustment.

In U.S. Pat. No. 6,260,491, I describe a tiltable nozzle tip that addresses the problem of excessive heating by directing air over the front part of the outer shell of the nozzle tip from a channel formed between a rear part of the outer shell and an external shroud provided on the nozzle tip. The air flows from the channel along the front part of the outer shell even when the nozzle tip is tilted, and thereby protects the nozzle tip from distortion and failure due to excessive heat.

Although the air-directing channels described in U.S. Pat. No. 6,260,491 are effective to reduce thermal distortion and high temperature oxidation of a nozzle tip, even a nozzle tip equipped with such air-directing channels is subject to eventual failure due to thermal distortion and oxidation when exposed to radiation and hot gases in a furnace over an extended time.

A problem inherent in conventional fuel and air nozzle tips, as well as in nozzle tips equipped with air-directing channels, is that the outside surfaces of the nozzle tips are exposed to high temperatures due to flame radiation, conduction of heat from hot gases, or a combination of radiation and conduction, while the fuel, air, or a combination of fuel and air passing through the inside of the nozzle is relatively cool, and tends to cool the inside surfaces of the nozzle. The difference between the temperature of the outside surfaces and the temperature of the inside surfaces results in a high temperature gradient across the plates or castings that make up the nozzle. When one side of a plate or casting is cooled while the other side becomes very hot due to furnace radiation, hot gas, or both, the plate or casting distorts, and the structural integrity of the nozzle is compromised. The nozzle becomes less effective for its intended purpose, and its service life is shortened.

SUMMARY OF THE INVENTION

This invention provides an improved fuel nozzle or air nozzle that is better able than existing designs to prevent thermal distortion due to exposure to radiation and hot gases in a furnace. The invention can also be applied to existing designs to extend their service life.

Briefly, closely-spaced cooling holes are provided in the walls of the nozzle tip wherever exposure to radiation is expected, preferably in offset or parallel patterns. Air, generally at a low pressure, e.g., less than about 30 in. wg., flows through the holes, reducing the thermal gradient across the wall of the nozzle tip by conduction. The air flow also keeps flames away from the surfaces of the nozzle tip and thereby aids in inhibiting radiation impingement.

As the nozzle tip is tilted or yawed, the secondary air flowing into the nozzle tip flows in greater volume through the cooling holes in the nozzle tip wall that has greater exposure to radiation as a result of tilting or yawing of the nozzle tip.

Although the invention resides essentially in improvement in nozzles, it can be better defined in the context of a furnace incorporating one or more of the nozzles. The furnace comprises an enclosure in which combustion takes place, and a nozzle for feeding a combustion-maintaining medium, including air, into the furnace.

The nozzle comprises a nozzle tip, at least partly protruding into the enclosure, and a feeding conduit arranged to direct a combustion-maintaining medium through the nozzle tip into the furnace. The nozzle tip includes a passage for the flow of combustion-maintaining medium through the nozzle tip into the furnace, the passage being bounded in part by at least one wall having an outer surface directly exposed to heat generated by combustion in the furnace, and an opposite, inner, surface directly exposed to, and cooled by, the combustion-maintaining medium in the passage. This wall of the nozzle tip is foraminous. That is, it has an array of openings each providing for the flow of air from the passage to the outer surface of the wall, whereby the temperature difference between the inner and outer surfaces is moderated.

The array of openings becomes particularly advantageous when the nozzle tip is a tiltable and/or yawable nozzle tip, arranged so that the quantity of radiant heat, from combustion in the furnace, to which the foraminous wall of the nozzle tip is exposed varies as the nozzle tip is tilted. In the case of a tiltable nozzle tip, if the radiant heat to which the foraminous wall of the nozzle tip is exposed increases as the nozzle tip is tilted, the flow of air through the openings in the foraminous wall also increases, thereby more effectively moderating the temperature difference between the inner and outer surfaces of that wall.

In a version of the tiltable nozzle tip mounted for both pitch and yaw adjustment and having four walls, each of the walls can be provided with an array of openings providing for the flow of combustion-maintaining medium from its inner surface to its outer surface. In such an embodiment, regardless of the direction to which the nozzle tip is adjusted, an increased cooling effect is realized at the wall having the greatest exposure to radiant heat.

Further objects and advantages of the invention will be apparent from the following description when read in conjunction with the drawings.

DETAILED DESCRIPTION OF THE PREFERRED EMBODIMENTS

Figure 1:
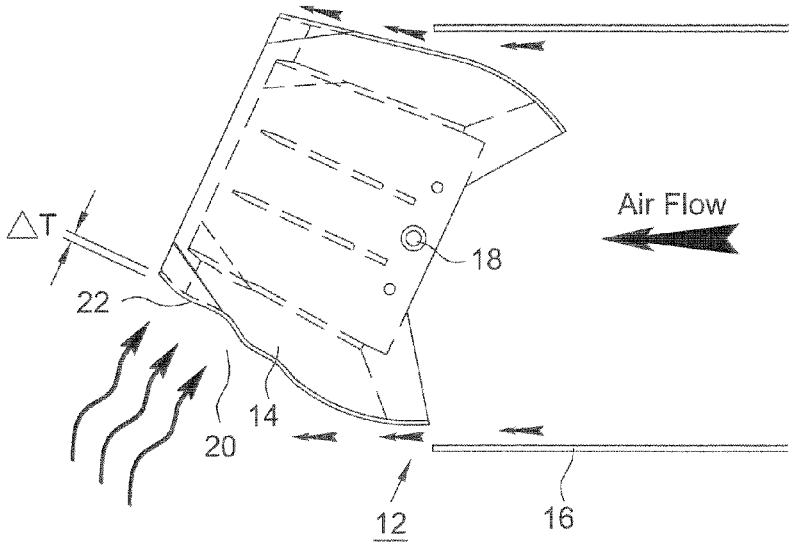
FIG 1 (Prior Art)
FIG. 1 is a schematic side elevational view of a conventional tilting nozzle tip, showing how tilting of the nozzle can result in distortion due to an excessive temperature difference between the inner and outer surfaces of the nozzle.

In the conventional nozzle of FIG. 1, coal along with air is delivered to the interior of a boiler furnace through a coal nozzle 12 and a tilting nozzle tip 14. Secondary air in conduit 16 is also delivered through the tilting nozzle.

The nozzle is mounted on trunnions, one of which is shown at 18, and tiltable on a horizontal axis. That is, its pitch can be adjusted. In FIG. 1, the nozzle tip is tilted upward. As shown by arrows, air flowing from conduit 16 through a leakage path between the conduit and the nozzle tip flows along the top wall of the nozzle tip, keeping the upper part of the nozzle tip cool. However, the air leaking through the space between the conduit and the lower part of the nozzle tip tends to separate from the nozzle tip allowing a dead zone 20 to exist adjacent the bottom wall 22 of the nozzle tip. As a consequence of the dead zone, the air flowing through the space between the conduit wall and the lower part of the nozzle tip has comparatively little cooling effect. Radiant heat is indicated by wavy lines. Because of the reduced cooling effect resulting from the separation of air from the lower wall of the nozzle tip, radiant heat from the flame in the boiler furnace, impinging on the nozzle tip, can produce an excessively high temperature on the outer surface of the bottom wall of the nozzle tip. Air flowing within the nozzle tip, on the other hand, is effective to cool the inside surface of the bottom wall. Consequently, a temperature difference $\Delta T$ exists across the wall, and this temperature difference can cause differential expansion and distortion of wall of the nozzle tip.

Figure 2:
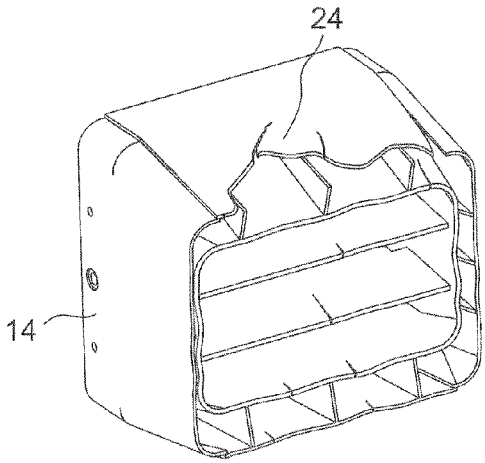
FIG 2 (Prior Art)
FIG. 2 is a oblique perspective view showing the condition of a conventional tilting nozzle tip, after a prolonged exposure to radiant heat in a furnace.
Figure 3:
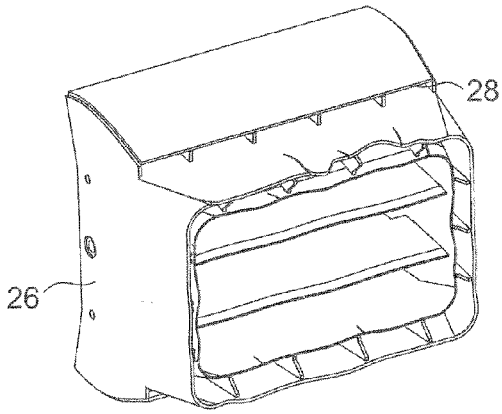
FIG 3 (Prior Art)
FIG. 3 is an oblique perspective view showing the condition of a tilting nozzle tip according to U.S. Pat. No. 6,260,491, after a prolonged exposure to radiant heat in a furnace.

Distortion of the outer wall of a conventional nozzle tip 14 is seen at 24 in FIG. 2. This figure also depicts significant destruction of the wall of the nozzle tip due to oxidation at very high temperatures. In the nozzle tip 26 in FIG. 3, which is designed according to U.S. Pat. No. 6,260,491, air flow directed by an outer shroud 28 reduces high temperature oxidation and deterioration of the nozzle tip wall. However, there is still some distortion due to the temperature difference between the inner and outer surfaces of the nozzle tip wall.

Distortion of nozzle tips is exacerbated not only by vertical tilting as illustrated in FIG. 1, but also horizontal yawing in installations in which the nozzle direction is adjustable about a vertical axis. In each such case, separation of air flow contributes to the temperature difference $\Delta T$. Also contributing to the temperature difference is the fact that, in the case of a tilted or yawing nozzle tip, a given area of the outer surface of the nozzle tip is exposed to a greater quantity of radiation as the angle between that area of the nozzle surface and the direction of impinging radiation approaches 90°. In a similar way, any tapering of the nozzle tip can contribute to the nozzle's susceptibility to damage due to excessive heating. Parts of the outer surface of a tapered nozzle tip also tend to be exposed to a greater quantity of radiation for a given surface area than corresponding parts of a non-tapered nozzle tip.

Figure 4:
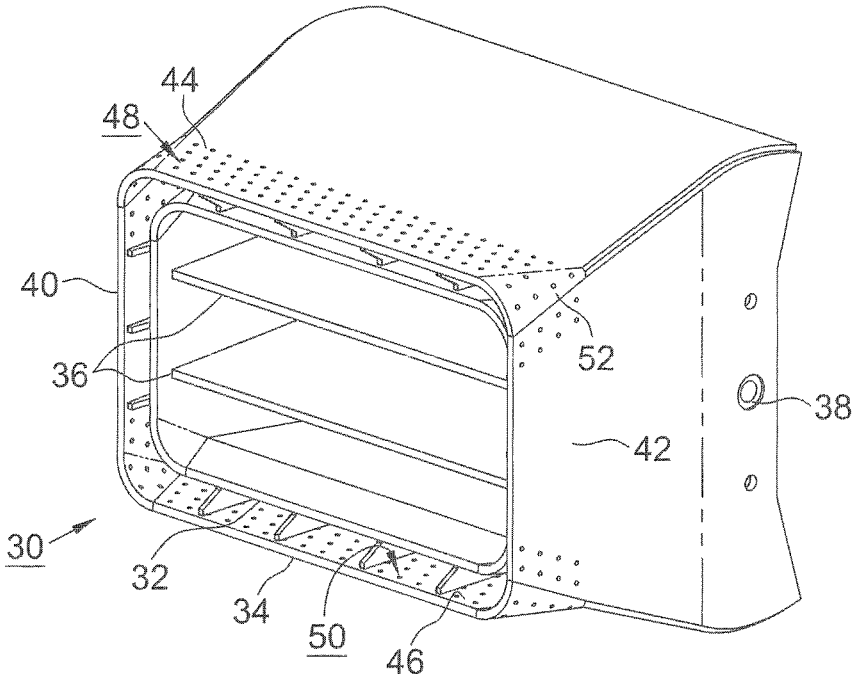
FIG. 4 is an oblique perspective view of a first embodiment of a tilting nozzle tip according to the invention.

The nozzle tip in FIG. 4 is similar to a conventional vertically tilting nozzle tip, being composed of an inner shell 32 surrounded by an outer shell 34. Horizontal splitter plates 36 divide the interior of the inner shell into plural flow passages for flow of coal particles and air. Secondary air flows through the space between the inner and outer shells. The nozzle tip is mounted on trunnions, one of which is shown at 38, for tilting about a horizontal axis.

The outer shell is typically, but not necessarily, tapered, and is composed of two vertical side walls 40 and 42, and upper and lower walls 44 and 46, respectively. The nozzle is tapered both in plan view and in elevational view, and the rear portions of the upper and lower walls are convex so that the gap between the nozzle tip and the nozzle (not shown) in which it fits remains substantially the same regardless of the angle of tilt.

An array 48 of openings is provided in the upper wall 44 of the nozzle tip and a similar array 50 of openings is provided in the lower wall 46. The arrays are located adjacent the front opening of the outer shell and extend rearward to an intermediate location between the front and rear openings of the outer shell. As shown in FIG. 4, the transitions between the upper wall and the side walls and the transitions between the lower wall and the side walls are rounded at least in the vicinity of the front opening of the nozzle tip. One such transition is seen at 52. The arrays of holes extend into these rounded transitions.

The holes in the arrays allow flow of secondary air from the space between the inner and outer shells, through the outer shell, to the outer surface of the outer shell. Air, typically at a low pressure, around 30 in. wg, passes through the holes from the interior of the nozzle tip to the exterior, reducing the temperature difference between the inner and outer surfaces and thereby significantly reducing thermal distortion and resulting damage of the kind depicted in FIG. 2. When the nozzle is tilted, the flow of air through the holes in the wall facing the flame increases so that a greater cooling effect is achieved at the parts of the nozzle tip having the greater exposure to radiant heat. The flow of air through the array of holes washes the exposed outer surface of the nozzle tip with cool air in a film or boundary layer. The air flow also reduces direct contact between the flame and the nozzle tip.

The holes in the arrays can be of various sizes and shapes and arranged in various patterns. For example, the holes can be round or in the form of ellipses or elongated slots. They can be cylindrical, or tapered in either direction, and can be either perpendicular to the surfaces of the nozzle tip walls or angled. The holes can be in rows and columns, with or without an offset relationship between adjacent rows or columns. The array can also include holes of differing sizes and shapes.

Preferably, the holes, if round, have a minimum cross-sectional area of about 2 $mm^2$ (0.003 $in^2$), and a maximum cross-sectional area of about 126 $mm^2$ (0.2 $in^2$). In the case of an array of round, cylindrical holes, the minimum diameter should be the range from about 1/16 inch (1.6 mm) to ½ inch (12.7 mm).

The concentration of the holes can vary, but is preferably in a range such that, in a selected area of the outer surface of a nozzle tip that contains at least two contiguous rows of holes, each row having at least three holes, the ratio of the minimum hole cross section to the total area of the square is in the range from 2% to 35%. The angles of the holes relative to the plate surfaces, that is, the angle measured from the central axis of a hole to the adjacent plate surface can vary from 90° to 30°.

Figure 5:
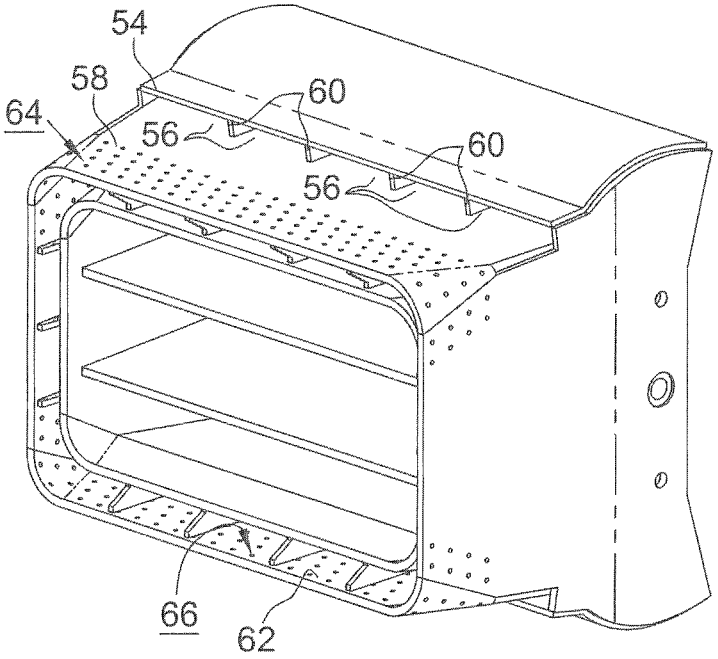
FIG. 5 is an oblique perspective view of a second embodiment of a tilting nozzle tip according to the invention.

The nozzle tip in FIG. 5 is similar to the nozzle tip in FIG. 4, but includes an outer shroud 54 forming channels 56, bounded by the outer shroud, the upper wall 58 of the nozzle tip, and shroud-supporting partitions 60, as described in U.S. Pat. No. 6,260,491. A similar structure (not shown in FIG. 5) is provided on the bottom side of the nozzle tip. The channels 56 direct secondary air along the outer surface of the upper wall 58 of the nozzle tip, and similar channels (not shown) direct air along the outer surface of the lower wall 62. It is possible to direct secondary air over the upper and lower walls of an alternative nozzle tip by adopting air-directing shrouds that do not overlap the upper and lower walls of the nozzle tip, thereby eliminating channels bounded in part by the upper and lower walls. In either case, although the secondary air flow achieved by the shrouds provides some cooling effect, a significant improvement in cooling can be realized by providing arrays 64 and 66 of holes in the upper and lower walls 58 and 62 of the nozzle tip respectively. These arrays of holes are similar to arrays 48 and 50 in the nozzle tip of FIG. 4.

In the nozzle tip of FIG. 5, the upper and lower outer shrouds are convex so that the gap between the nozzle tip and the nozzle (not shown) in which it fits remains substantially the same regardless of the angle of tilt.

Figure 6A:
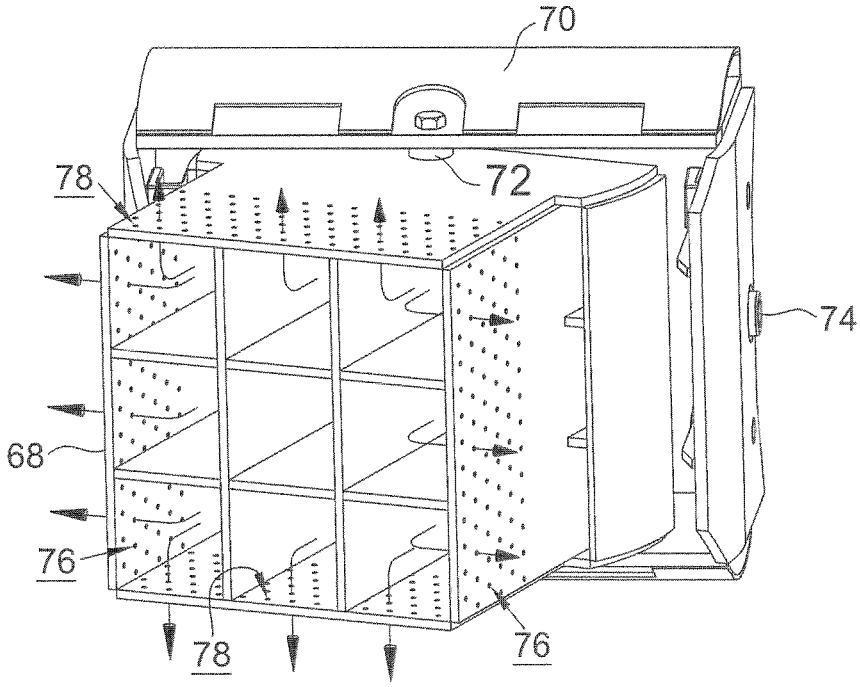
FIGS. 6*a*-6*d* are oblique perspective views showing four variations of a third embodiment of a tilting nozzle tip according to the invention.

The nozzle tip 68, shown in FIG. 6*a*, is an air nozzle tip, designed to introduce air into a furnace. This type of nozzle tip is commonly referred to as a "boundary air tip," a "concentric adjustable tip," or an "overfire air tip." This nozzle tip is mounted in a frame 70 on bearings, one of which is shown at 72, for yaw adjustment about a vertical axis so that it can be adjusted to reshape the fireball for improved control of slagging, waterwall corrosion, emissions, and oxygen and temperature profiles. The frame is provided with trunnions, one of which is shown at 74, that can be mounted in bearings (not shown) to provide a universal mount allowing both yaw and pitch adjustment. When a nozzle tip mounted for yaw adjustment is adjusted left or right, the exposure of one of its sides to radiant heat and hot gases is increased, and distortion can occur as in the case of a nozzle tip that is tiltable on a horizontal axis. In this case, the nozzle tip is provided with arrays 76 of holes in its side walls as well as arrays 78 of holes in its top and bottom walls As the exposure of a side wall of the nozzle tip to radiant heat increases, the air flow through its array of holes also increases, preventing an excessive difference between the temperatures of its inside and outside surfaces.

Figure 6B:
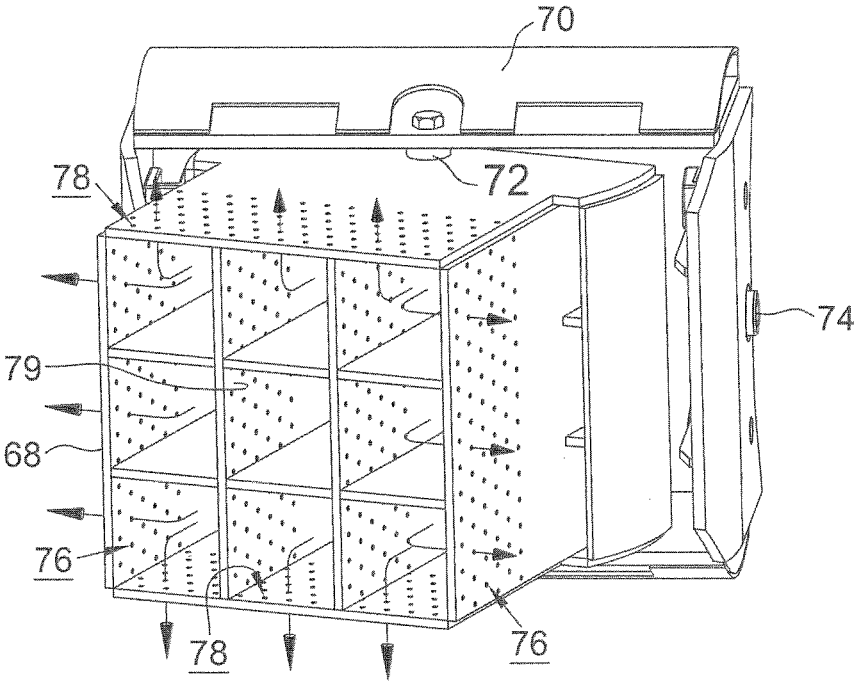
Figure 6C:
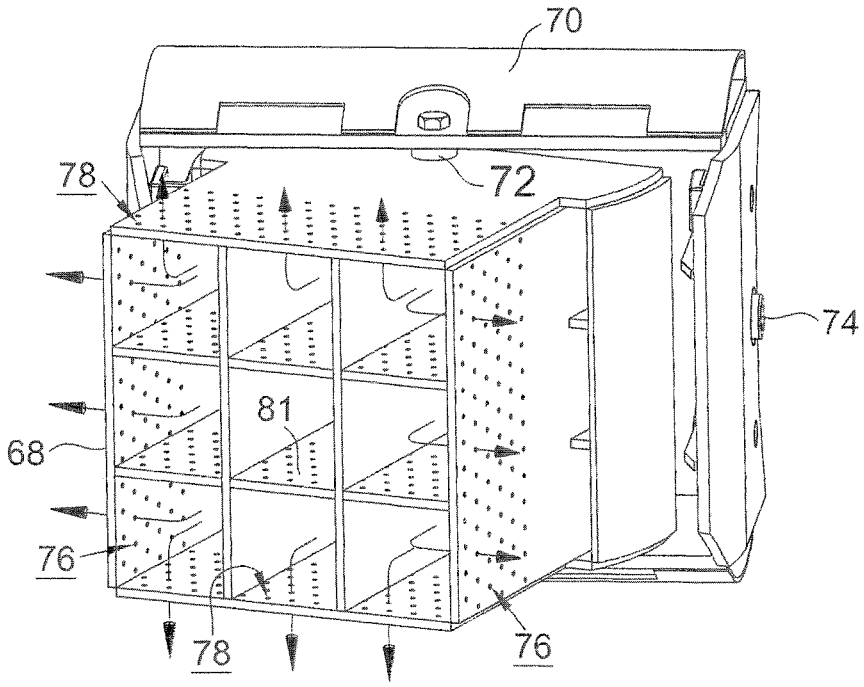
Figure 6D:
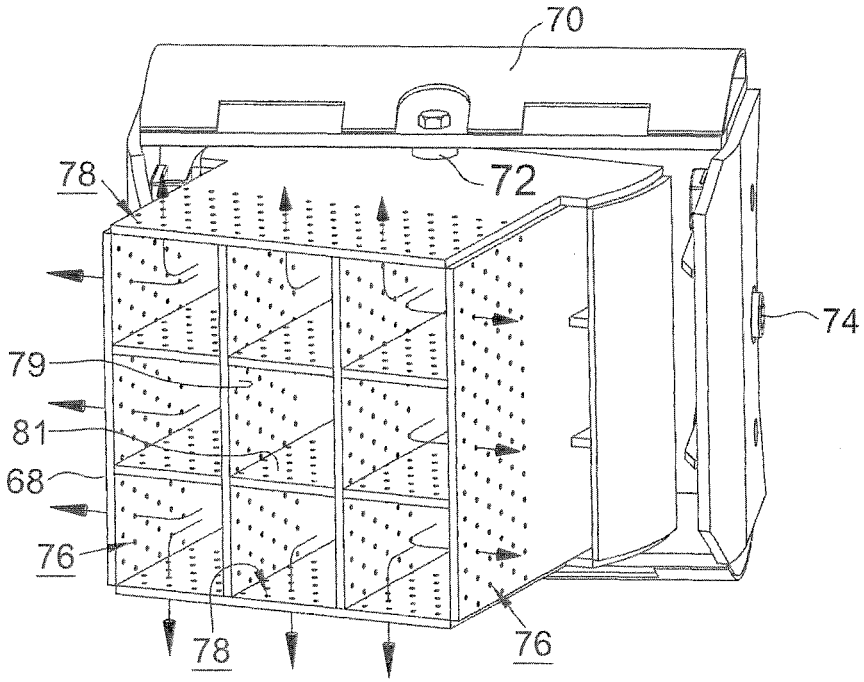

In the variations shown in FIGS. 6*a*-6*d*, corresponding arrays of holes are designated by the same reference numbers. In FIG. 6*b*, additional holes 79 are provided in the vertical inner baffles to reduce thermal distortion. In FIG. 6*c*, additional holes 81 are provided in the horizontal inner baffles. In FIG. 6*d*, additional holes 79 and 81 are provided in the vertical inner baffles, and in the horizontal inner baffles, respectively. These additional 79 and 81 can be useful especially where the inner baffles are subject to temperature differentials that can cause thermal distortion. Various other combinations of hole arrays can be used, depending on what elements of a nozzle are most susceptible to distortion.

Whereas yaw adjustment is most commonly utilized in the case of an air nozzle, it is also possible to provide for yaw adjustment, or both pitch and yaw adjustment, of a coal nozzle. In that case, the side walls of the coal nozzle, as well as the top and bottom walls, can be provided with arrays of air holes similar to this in FIG. 6.

Figure 7:
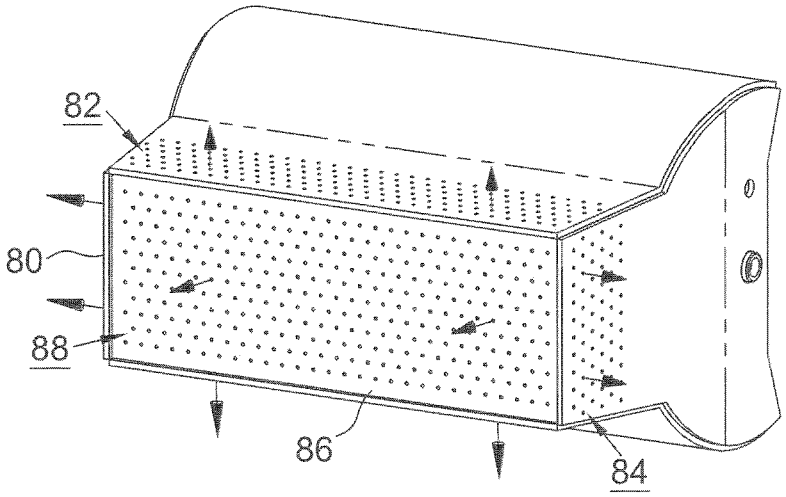
FIG. 7 is an oblique perspective view of a fourth embodiment of a tilting nozzle tip according to the invention.

The nozzle tip 80, shown in FIG. 7, is a nozzle tip designed for operation with low air flow. Such a nozzle can be used as a close-coupled overfire air nozzle in an upper windbox, which is generally operated with the dampers nearly closed. In this case, the top is provided with an array of air holes 82, the bottom is provided with a similar array of air holes (not shown), the left side is provided with an array of air holes 84, and the right side is provided with a similar array of air holes (not shown). The nozzle tip 80 has a front wall 86 with an array of air holes 88.

At low air flows, the front panel helps to maintain a velocity through the holes in the top, bottom and side walls sufficient to prevent an excessive temperature difference between the inside and outside surfaces of these walls, and thereby inhibit thermal distortion. Air flow through the holes 88, of course, inhibits thermal distortion of the front wall 86.

Figure 8:
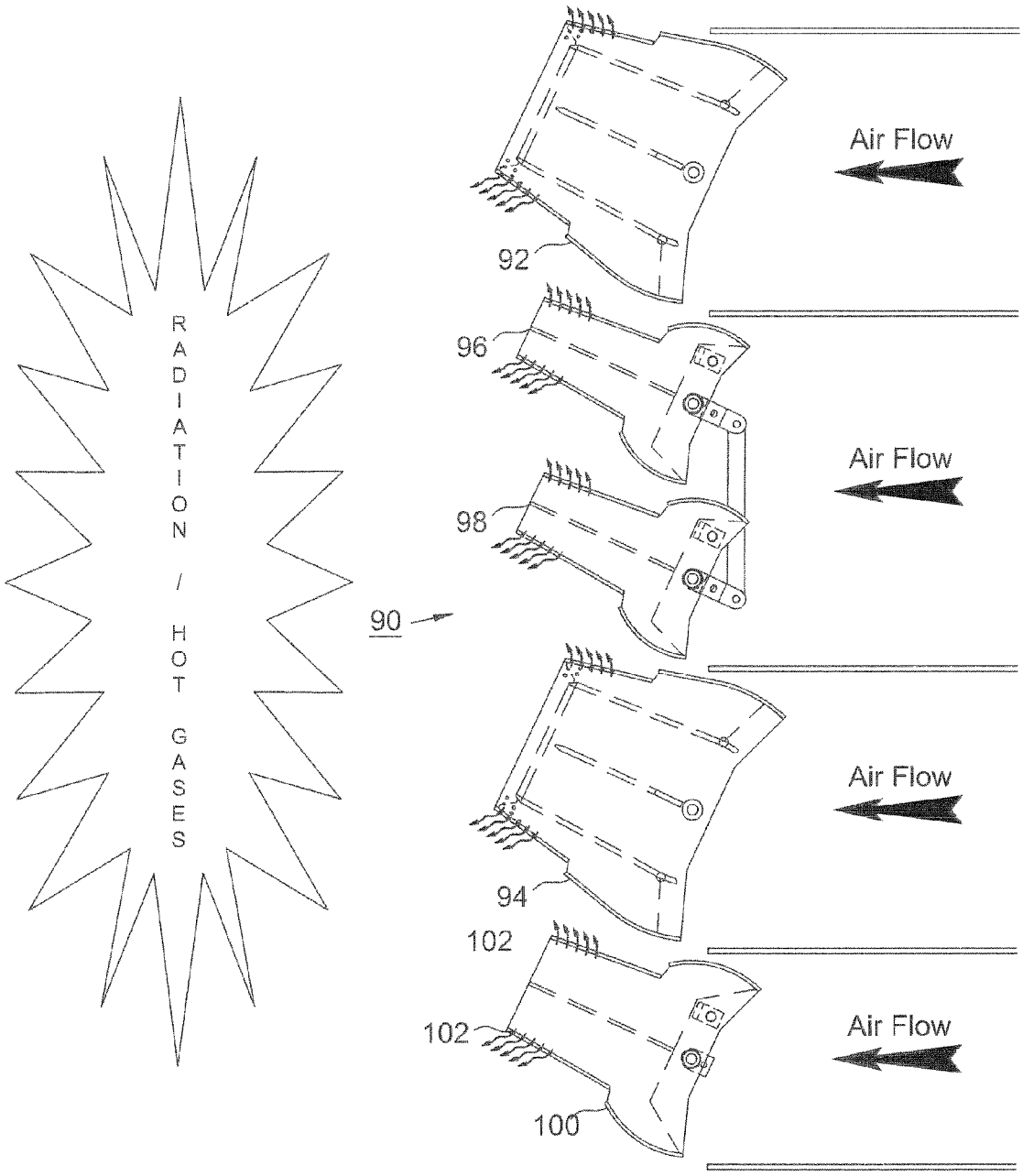
FIG. 8 is a schematic vertical section, showing an array of tilting nozzle tips according to the invention.

In FIG. 8, the nozzles, in an array including coal nozzles 92 and 94 and air nozzles 96, 98 and 100, are tilted upward so that their bottom walls have a greater exposure to radiant heat and hot gases in a boiler to which they supply combustion media, i.e., air and coal particles. The top walls of the nozzles, on the other hand are relatively well protected from exposure to radiant heat and direct exposure to hot gases. Although most of the air entering the nozzles, including secondary air, exits though the large front openings, a small quantity of air flows through the air holes 102 in the top and bottom walls of the nozzles. As indicated by the small arrows, as a result of the upward tilt of the nozzles, the flow of air through the holes in the bottom walls is greater than the flow of air through the holes in the top walls. Accordingly, the air flow through the holes in the walls having the greater exposure to radiant heat and hot gases is greater than the air flow through the holes in the walls having lesser exposure. The same holds true, of course, when the nozzles are tilted downward.

The air holes of the invention can be utilized beneficially in internal vertical and horizontal stiffeners in a nozzle tip, including the stiffeners used to support the outer shell in a coal nozzle tip. In addition, air holes can be utilized in other fuel firing components, such as the oil swirler/diffuser 104 shown in FIG. 9*a*. The front sides of the vanes in a swirler/diffuser are more directly exposed than the back sides to radiation and hot gases in a furnace fed by the swirler/diffuser. However, in a conventional swirler/diffuser, the air flow over the front sides of the vanes will not necessarily be as great as the air flow over the back sides, and consequently radiant heating of the front sides of the vanes can result in temperature difference that can lead to distortion and failure.

Figure 9A:
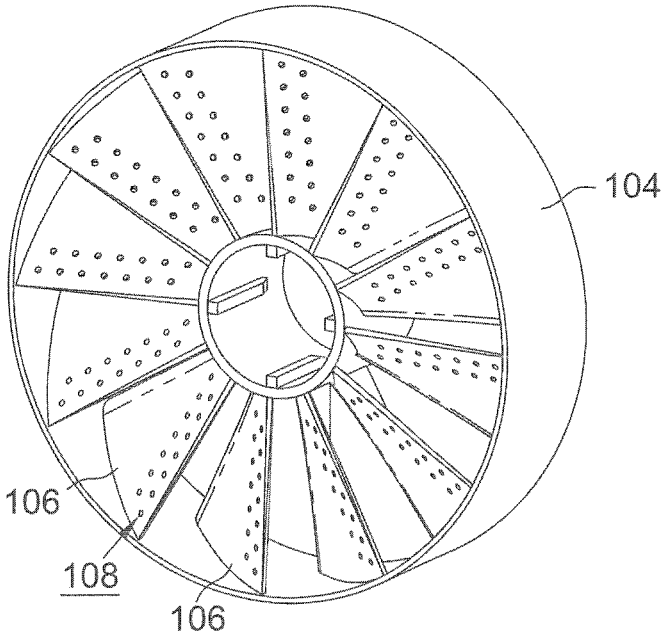
FIGS. 9*a* and 9*b* are oblique perspective views showing two variations of a oil swirler/diffuser incorporating features of the invention.

In the swirler/diffuser of FIG. 9*a*, which is a twelve inch diameter diffuser, the vanes 106 are provided with arrays of air holes 108, adjacent their trailing edges. The air holes allow a quantity of air to flow from the back side to the front side, thereby reducing the temperature difference between the back and front sides.

Figure 9B:
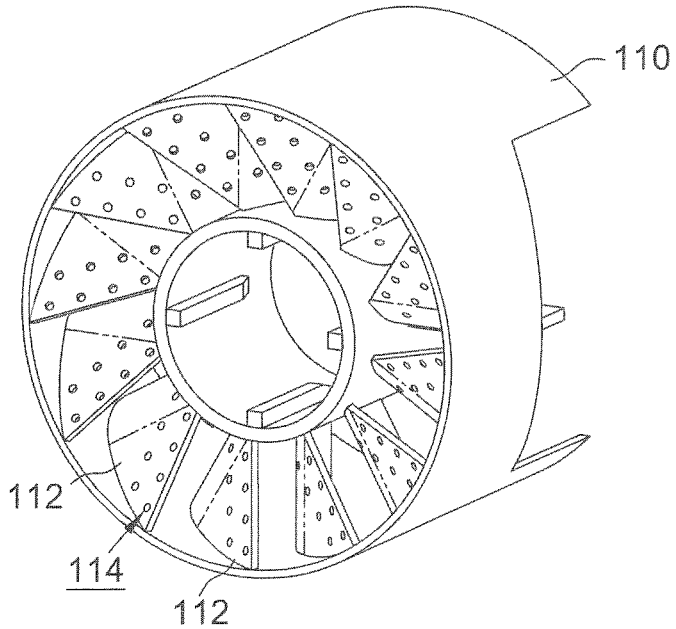

The swirler/diffuser 110 in FIG. 9*b* is an example of a 7.5 inch diameter diffuser, having arrays 112 of air holes in its vanes 114. The arrays of air holes in both swirler diffusers have the same effect: reduction of distortion of the vanes due to excessive heating of the exposed sides of the vanes adjacent the trailing edges.

Air holes corresponding to those described above can also be used in other fixed nozzles including fixed tangential nozzle tips and other burner components that are exposed to, and subject to damage by, radiation.

What is claimed is:

1. A furnace comprising an enclosure in which combustion takes place, and a nozzle for feeding a combustion-maintaining medium including air into the furnace, the nozzle comprising:

a nozzle tip, at least partly protruding into the enclosure; and a feeding conduit arranged to direct a combustion-maintaining medium including air in a first direction into the nozzle tip, and through the nozzle tip into the furnace;

the nozzle tip including a passage for the flow of combustion-maintaining medium through the nozzle tip into the furnace, said passage being bounded in part by at least one wall having an outer surface directly exposed to heat generated by combustion in the furnace, and an opposite, inner, surface directly exposed to, and cooled by air in the combustion-maintaining medium in said passage, said inner surface of said at least one wall being positioned at an angle relative to said first direction such that air directed by said feeding conduit into the nozzle tip impinges obliquely upon said inner surface; and said at least one wall of the nozzle tip having an array of openings each providing for the flow of air from said passage to the outer surface of said wall, whereby the temperature difference between said inner and outer surfaces is moderated.

2. A furnace according to claim 1, in which said nozzle tip is a tiltable nozzle tip, and in which the radiant heat, from combustion in the furnace, to which said wall of the nozzle tip is exposed varies as the nozzle tip is tilted.

3. A furnace according to claim 1, in which said nozzle tip is a tiltable nozzle tip, and in which the radiant heat, from combustion in the furnace, to which said wall of the nozzle tip increases as the nozzle tip is tilted in a first direction, and in which said wall is oriented so that the flow of air through said openings also increases as said nozzle tip is tilted in said first direction.

4. A tiltable nozzle tip for directing a combustion-maintaining medium including air into the furnace, the nozzle tip having a passage for the flow of combustion-maintaining medium including air in a first direction into said nozzle tip through the nozzle tip into the furnace, said passage being bounded in part by at least one wall having an outer surface and an opposite inner surface, said at least one wall of the nozzle tip being positionable, by tilting of the nozzle tip, at an angle relative to said first direction such that air flowing into the nozzle tip in said first direction impinges obliquely upon said inner surface, and said at least one wall having an array of openings each providing for the flow of air from said passage to the outer surface of said wall, whereby the temperature difference between said inner and outer surfaces is moderated.

5. A tiltable nozzle tip according to claim 4, in which said inner and outer surfaces of said wall are substantially planar and parallel to each other, and in which said nozzle tip has trunnions arranged to allow tilting of the nozzle tip about a first axis parallel to said inner and outer surfaces.

6. A tiltable nozzle tip according to claim 4, in which said passage of the nozzle tip is bounded in part by two opposed walls, each of said walls having an outer surface, an opposite inner surface and an array of openings each providing for the flow of combustion-maintaining medium from said passage to its outer surface, whereby the temperature difference between said inner and outer surfaces is moderated.

7. A tiltable nozzle tip according to claim 6, in which said inner and outer surfaces of each of said walls are substantially planar and parallel to each other, and in which said nozzle tip has trunnions arranged to allow tilting of the nozzle tip about a first axis parallel to the inner and outer surfaces of both of said walls.

8. A tiltable nozzle tip according to claim 4, in which said passage of the nozzle tip is bounded by four walls, each of said walls having an outer surface, an opposite inner surface and an array of openings each providing for the flow of combustion-maintaining medium from said passage to its outer surface, whereby the temperature difference between said inner and outer surfaces is moderated.

9. A tiltable nozzle tip according to claim 8, in which said nozzle tip is mounted for pitch adjustment about a substantially horizontal axis and also for yaw adjustment about a substantially vertical axis.

* * * * *